US007062350B2

(12) United States Patent
Peterson

(10) Patent No.: US 7,062,350 B2
(45) Date of Patent: Jun. 13, 2006

(54) CONTROL METHOD AND APPARATUS FOR A WORK TOOL

(75) Inventor: Daniel D. Peterson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/967,708

(22) Filed: Oct. 18, 2004

(65) Prior Publication Data

US 2006/0085096 A1 Apr. 20, 2006

(51) Int. Cl.

| | |
|---|---|
| ***G06F 19/00*** | (2006.01) |
| ***G06F 7/70*** | (2006.01) |
| ***G06G 7/00*** | (2006.01) |
| ***G06G 7/76*** | (2006.01) |

(52) U.S. Cl. ..... 700/159; 701/50; 172/40

(58) Field of Classification Search ..... 700/159; 701/50; 404/113–117; 172/40

See application file for complete search history.

(56) References Cited

U.S. PATENT DOCUMENTS

| | | | | |
|---|---|---|---|---|
| 5,860,231 | A | 1/1999 | Lee et al. | |
| 6,725,105 | B1 | 4/2004 | Francis et al. | |
| 6,757,992 | B1 * | 7/2004 | Berger et al. | 37/348 |
| 2005/0203691 | A1 * | 9/2005 | Kim | 701/50 |

* cited by examiner

*Primary Examiner*—Leo Picard
*Assistant Examiner*—Ryan A. Jarrett
(74) *Attorney, Agent, or Firm*—Steve D. Lundquist

(57) ABSTRACT

A method and apparatus for controlling a work tool. The method and apparatus includes receiving a command to engage a vibratory mode of the work tool, actuating the vibratory mode, and increasing at least one of an amplitude and a frequency of vibration as a function of time during receipt of the command.

10 Claims, 4 Drawing Sheets

CONTROL METHOD AND APPARATUS FOR A WORK TOOL

TECHNICAL FIELD

This invention relates generally to a method and apparatus for controlling a work tool and, more particularly, to a method and apparatus for controlling a vibratory motion of a work tool to perform a work function.

BACKGROUND

During operation of work machines, it is sometimes desirable to move a work tool in a vibratory manner to accomplish some purpose. For example, an operator of earthworking machine having a work tool such as a bucket may desire to cause the bucket to move in a vibratory manner to shake material out of the bucket that does not readily fall out, to cause the bucket to penetrate hard material such as clay or rock, to compact a surface, or to perform some other function.

In the past, the standard method for vibrating a work tool has been for the operator to rapidly move the work tool control, such as a joystick or lever, back and forth until the task was completed. This involves rapid motion by the operator that, over time, can become tedious and tiring. This technique is also only good for certain work functions, such as shaking material out of the tool. Other functions, such as vibratory compaction of a surface, cannot be efficiently performed by manual operation.

With the advent of electro-hydraulics, it has become possible to automate control of work tools in many ways that required manual control in the past. Computer-based controllers can be programmed to operate electro-hydraulic valves and solenoids with great precision, thus alleviating many of the difficult, tedious, tiring and time-consuming tasks that operators previously had to perform.

In U.S. Pat. No. 6,725,105, Francis et al. attempt to make the manual process more efficient by introducing an abrupt mode during bucket shakeout operations. The motion of the work tool, i.e., bucket, changes from a smooth mode to an abrupt mode under certain operating criteria to make the shaking procedure more effective. However, manual manipulation is still required, and the abrupt mode still does not address other work functions, such as compacting.

In U.S. Pat. No. 5,860,231, Lee et al. discloses a system which automates the vibratory motion of a work tool by operator selection of a vibratory mode. The automatic method allows for work tool vibratory applications for several purposes, such as excavating, ground breaking, ground hardening (compaction), and the like. The operator, however, must still assert control over the work function by moving a joystick or lever to select desired amplitudes and frequencies of vibrations.

The present invention is directed to overcoming one or more of the problems as set forth above.

SUMMARY OF THE INVENTION

In one aspect of the present invention a method for controlling a work tool is disclosed. The method includes the steps of receiving a command to engage a vibratory mode of the work tool, actuating the vibratory mode, and increasing at least one of an amplitude and a frequency of vibration as a function of time during receipt of the command.

In another aspect of the present invention a method for controlling a work tool is disclosed. The method includes the steps of delivering a command to engage a vibratory mode of the work tool, and terminating delivery of the command in response to determining that the vibratory mode is no longer desired, wherein a controller actuates the vibratory mode and increases at least one of an amplitude and a frequency of vibration during delivery of the command.

In another aspect of the present invention an apparatus for controlling a work tool is disclosed. The apparatus includes a switch for delivering a command to engage a vibratory mode of the work tool, and a controller for receiving the command, actuating the vibratory mode, and increasing at least one of an amplitude and a frequency of vibration as a function of time during receipt of the command.

In another aspect of the present invention an apparatus for controlling a work tool on a work machine is disclosed. The apparatus includes at least one hydraulic cylinder mounted on the work machine and operably connected to the work tool, at least one electro-hydraulic valve operably connected to the at least one hydraulic cylinder, a controller electrically connected to the at least one electro-hydraulic valve, and an operator controlled switch electrically connected to the controller, wherein the controller is configured to actuate the hydraulic cylinder by way of the electro-hydraulic valve to a vibratory mode which increases in at least one of amplitude and frequency during activation of the switch.

In another aspect of the present invention a method for operating a work tool on a work machine in a vibratory mode is disclosed. The method includes the steps of determining a switch activation indicative of a command to engage the vibratory mode, determining at least one of an initial desired amplitude and initial desired frequency of vibration of the work tool, determining a desired rate of increase of at least one of the amplitude and frequency of vibration, actuating the vibratory mode at the at least one of the initial desired amplitude and frequency, increasing the at least one of the amplitude and frequency at the desired rate of increase, determining a switch deactivation indicative of a command to disengage the vibratory mode, and responsively disengaging the vibratory mode.

DETAILED DESCRIPTION

Figure 1:
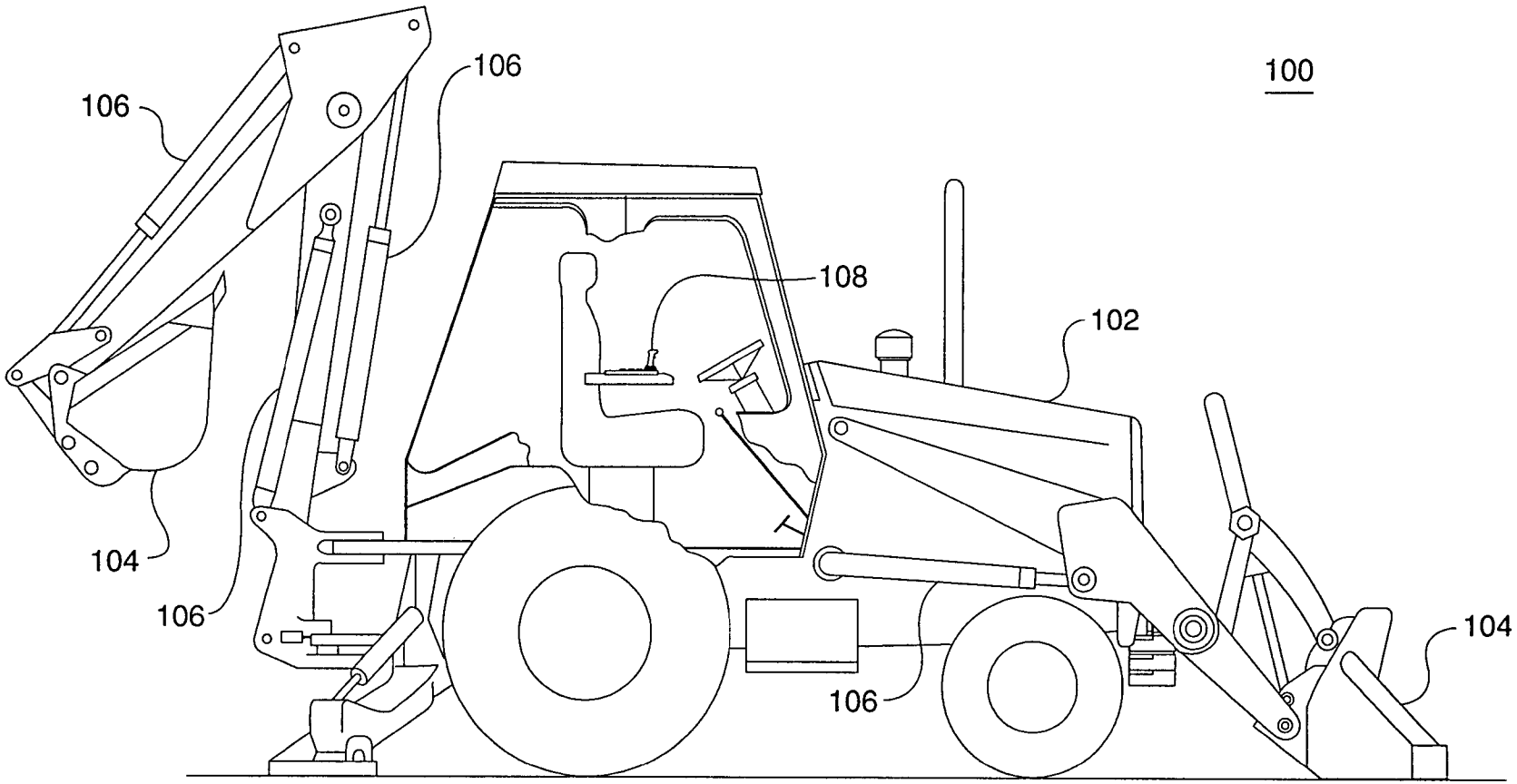
FIG. 1 is a diagrammatic illustration of a work machine suited for use with the present invention.

Referring to the drawings and the appended claims, a method and apparatus 100 for controlling a work tool 104 on a work machine 102 is shown and described.

With particular reference to FIG. 1, an example of a work machine 102 suited for use with the present invention is shown. The work machine 102 is shown as an earthworking machine, in particular, a backhoe loader. However, other types of earthworking machines may apply; for example, excavators, wheel loaders, skid steer loaders, front shovels, track loaders, and the like. Furthermore, the work machine 102 may be of a type other than an earthworking machine. For example, the work machine 102 may be a machine used for construction, material transfer, manufacturing, agriculture, and such, provided that the present invention may find application with the machine.

A work tool 104, mounted on the work machine 102, performs a work function of some type. The work tool 104 shown in FIG. 1 is depicted as a bucket. More specifically, a work tool 104 embodied as a backhoe bucket is shown at the rear of the work machine 102, and another work tool 104 embodied as a loader bucket is shown at the front of the work machine 102. It is noted that, although both illustrated work tools are shown as buckets, other types of work tools may apply. Examples include, but are not limited to, augers, blades, cutting tools, trenchers, and the like.

Without intending to be limiting in scope and application, the present invention is hereunder described with exemplary reference to a work machine 102 being a backhoe loader having a work tool 104 that is a bucket for digging.

The work machine 102 exemplified may include at least one hydraulic cylinder 106 for controlling movement of the work tool 104. The work machine 102 of FIG. 1 includes at least one hydraulic cylinder 106 for control of the work tool 104 shown as the backhoe bucket, and at least one hydraulic cylinder 106 for control of the work tool 104 shown as the loader bucket. As is well known in the art, additional hydraulic cylinders 106 may also be used, for example, the hydraulic cylinders 106 in FIG. 1 may be replicated on the side of the work machine 102 not shown.

It is noted that the backhoe loader example is typically a hydraulically actuated and controlled machine. Other machines suited for use with the present invention may not necessarily include hydraulic control, and may instead rely on other types of control, such as electric, mechanical, and such.

Figure 2:
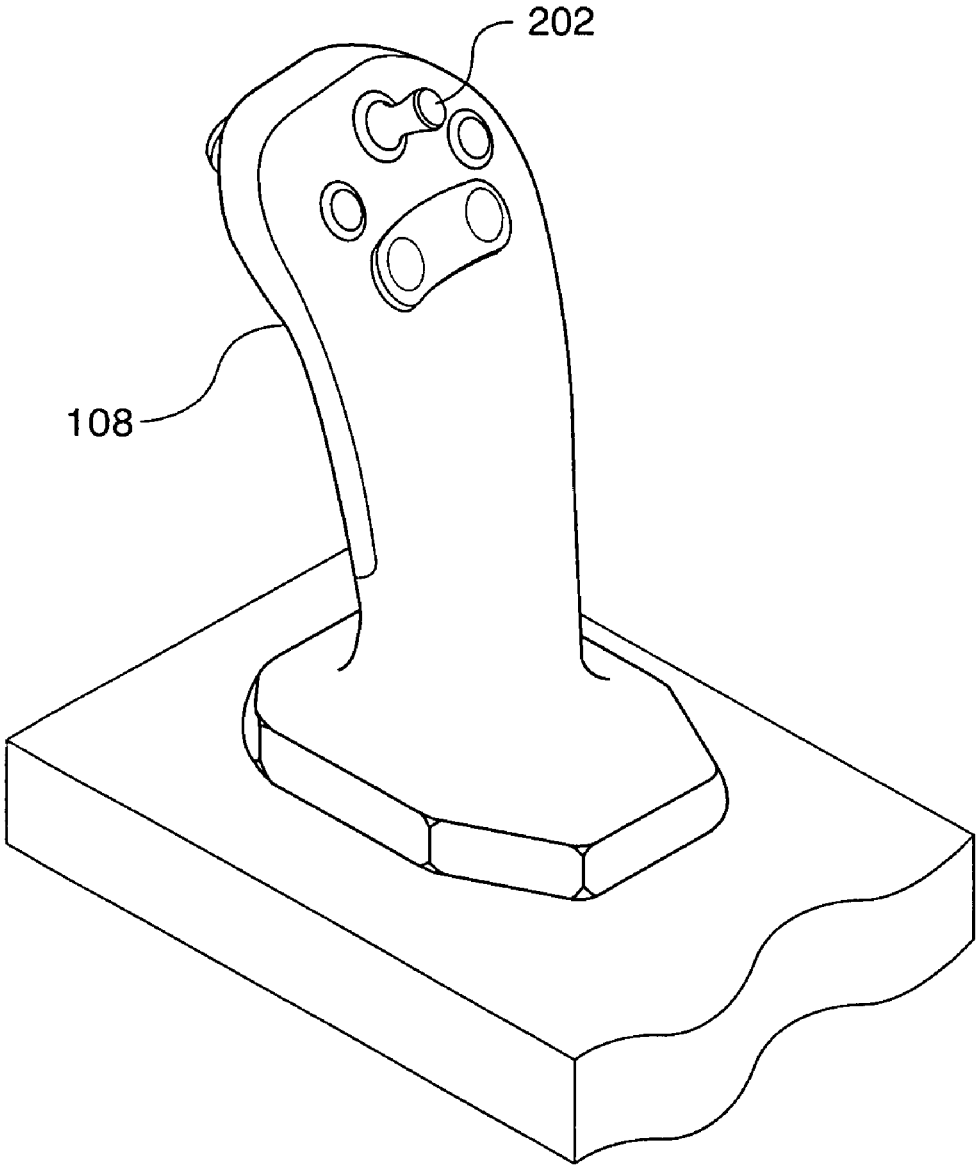
FIG. 2 is a diagrammatic illustration of a joystick as may be located on the work machine of FIG. 1.

In FIG. 1 and also with detailed reference to FIG. 2, an operator control embodied as a joystick 108 is shown. Although joysticks are commonly used to control work tool on work machines, other types of control devices may also be used, such as levers, switches, buttons, pedals, and the like. The joystick 108 of FIG. 2 also may include at least one button 202 for actuation of a function.

Figure 3:
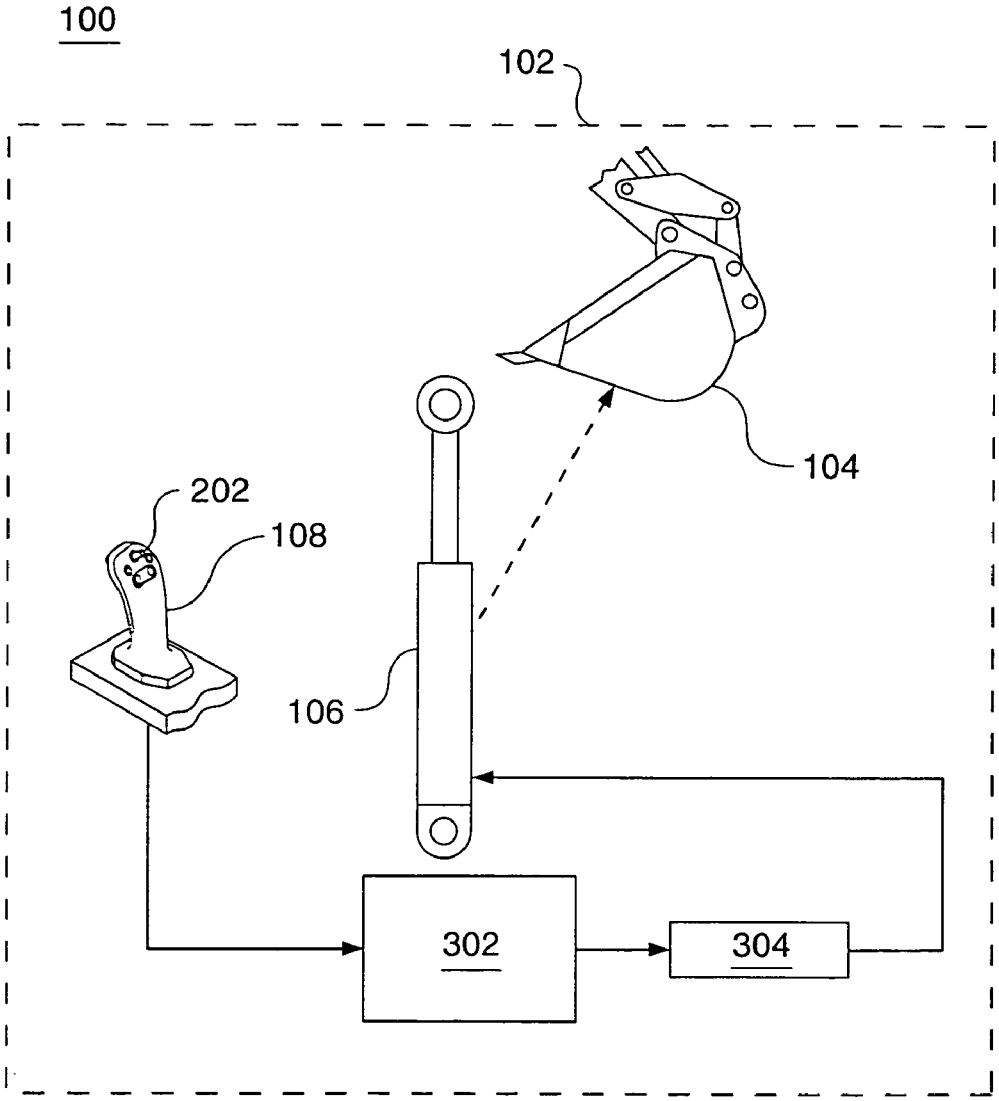
FIG. 3 is a block diagram depicting an embodiment of the present invention.

Referring to FIG. 3, a block diagram illustrating an embodiment of the present invention is shown. A controller 302 may be configured to receive command inputs from a switch such as the joystick 108 or button 202. The controller 302 may then send output commands to an electro-hydraulic valve 304, which in turn actuates a hydraulic cylinder 106, which controls movement of the work tool 104. The controller 302 may be microprocessor-based, i.e., computer-based, and may be dedicated for use with the present invention or may be used for other purposes as well. For example, the controller 302 may be an electronic control module (ECM) which performs a number of machine functions, and also has software included to specifically perform the work associated with the present invention.

INDUSTRIAL APPLICABILITY

Figure 4:
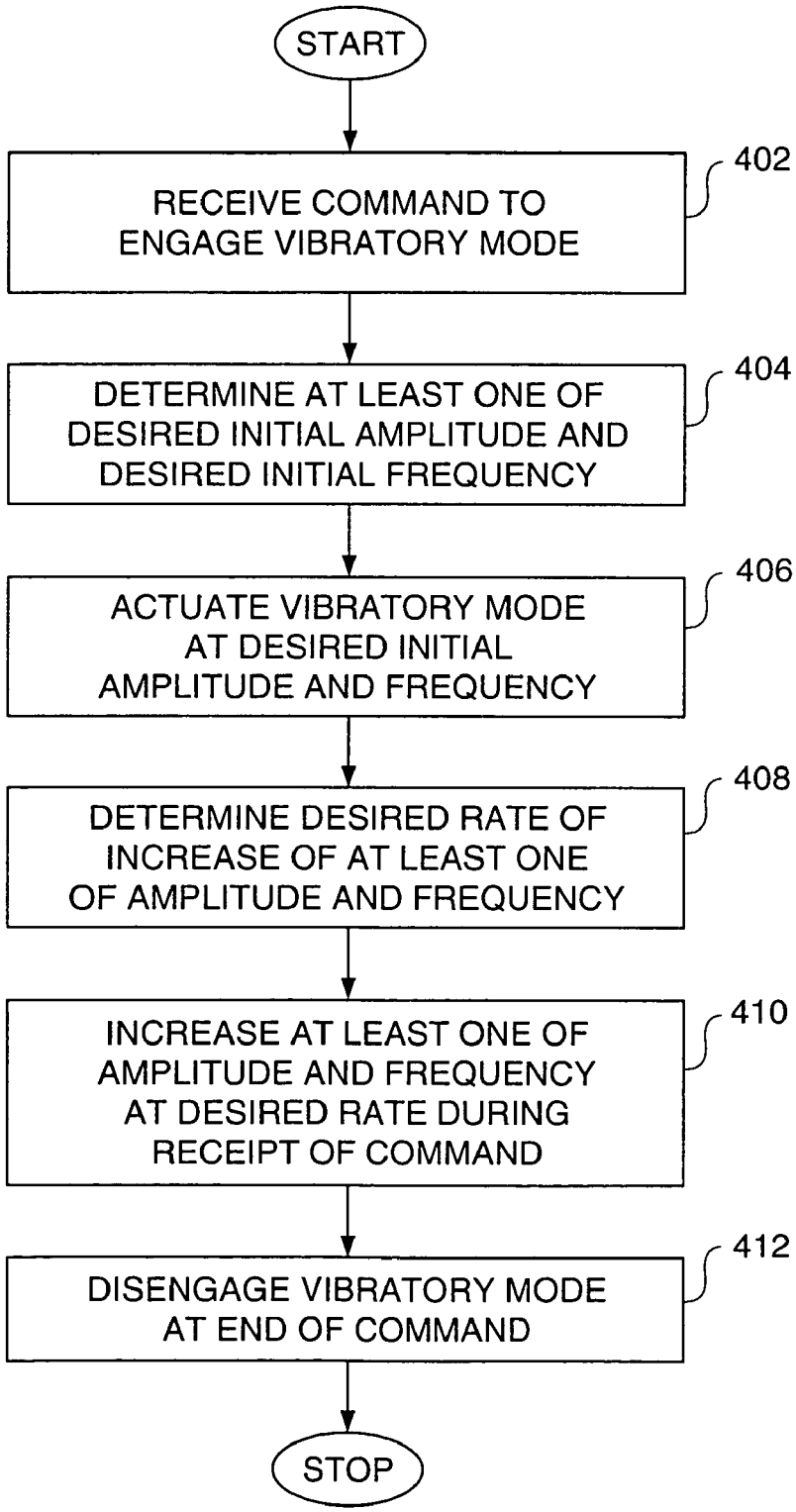
FIG. 4 is a flow diagram illustrating a method embodied in the present invention.

An example of application of the present invention may be shown with reference to the flow diagram of FIG. 4, in which an embodiment of a method for controlling a work tool 104 is shown.

In a first control block 402, a command is received to engage a vibratory mode. The command may be received by controller 302 upon an operator actuation of a joystick 108 or button 202 configured to initiate the vibratory mode. An example of a desired use of the vibratory mode may be to shake material from the work tool 104, such as dirt from a bucket or auger, by rapid back and forth motion of the work tool 104. Other examples may include vibratory compaction of a surface, vibrating the work tool 104 to penetrate hard soil or roots, and the like.

In a second control block 404, at least one of a desired initial amplitude, i.e., intensity, and a desired initial frequency of vibration is determined. The desired initial amplitude and frequency may be determined as a function of factors such as the type of work tool 104, the type of work machine 102, characteristics of the material being worked by the work tool 104, the type of work being performed, and the like.

In a third control block 406, the controller 302 actuates the vibratory mode at the desired amplitude and frequency. In the example of a hydraulically actuated backhoe loader, the controller 302 may send a command to one or more electro-hydraulic valves 304 to actuate one or more hydraulic cylinders 106, which in turn controllably move the work tool 104 in a vibratory, i.e., back and forth, manner.

In a fourth control block 408, a desired rate of increase of at least one of the amplitude and the frequency of vibration is determined. The desired rate of increase of amplitude and frequency may be determined as a function of factors such as soil condition (in the backhoe loader example), and may be determined to increase the efficiency of the work tool 104 during engagement of the vibratory mode.

In a fifth control block 410, the controller 302 sends commands which increase at least one of the amplitude and frequency at the desired rate during the period of time in which the command to engage the vibratory mode is received.

In a sixth control block 412, the controller 302, upon termination of the vibratory mode command, disengages the vibratory mode. Termination of the vibratory mode command may be determined as an operator releases the joystick 108 or button 202 which delivered the initial engage command.

The present invention offers advantages such as ease of operator control; that is, an operator need only actuate a command switch to engage the vibratory mode, rather than rapidly and manually moving a control back and forth to perform the same function.

Other aspects can be obtained from a study of the drawings, the disclosure, and the appended claims.

What is claimed is:

1. A computer-based method for controlling a work tool comprising the steps of:

receiving a command to engage a vibratory mode of the work tool, including receiving the command for a period of time;

actuating the vibratory mode; and increasing at least one of an amplitude and a frequency of vibration of the work tool responsively to a length of the period of time.

2. A computer-based method, as set forth in claim 1, wherein:

the receiving step includes receiving with an electronic controller an actuation signal from an operator input device; and further including the step of disengaging the vibratory mode in response to an end of receipt of the actuation signal.

3. A computer-based method, as set forth in claim 1, wherein actuating the vibratory mode includes the step of:

actuating the vibratory mode at a first initial amplitude and a first initial frequency based on a first set of factors; or actuating the vibratory mode at a second initial amplitude and a second initial frequency based on a second set of factors, at least one of the second initial amplitude and the second initial frequency being different from the first initial amplitude and the first initial frequency, respectively.

4. A computer-based method, as set forth in claim 3, wherein increasing at least one of an amplitude and a frequency of vibration includes the step of:

increasing at least one of the amplitude and the frequency at a first rate of increase based on a first set of factors; or increasing at least one of the amplitude and the frequency at a second rate of increase different from the first rate based on a second set of factors.

5. A method for controlling a work tool, comprising the steps of:

delivering a command to engage a vibratory mode of the work tool for a period of time; and terminating delivery of the command in response to determining that the vibratory mode is no longer desired;

wherein a controller actuates the vibratory mode and increases at least one of an amplitude and a frequency of vibration during delivery of the command responsive to a length of the period of time.

6. An apparatus for controlling a work tool, comprising:

a switch for delivering a command to engage a vibratory mode of the work tool; and a controller configured for receiving the command, responsively actuating the vibratory mode at an initial amplitude and an initial frequency of vibration, and increasing at least one of the amplitude and the frequency of vibration as a function of time during receipt of the command, said controller further being configured to cease the vibratory mode responsive to the command ceasing.

7. An apparatus for controlling a work tool on a work machine comprising:

at least one hydraulic cylinder mounted on the work machine and operably connected to the work tool;

at least one electro-hydraulic valve operably connected to the at least one hydraulic cylinder;

a controller electrically connected to the at least one electro-hydraulic valve; and an operator controlled switch electrically connected to the controller;

wherein the controller is configured to actuate the hydraulic cylinder by way of the electro-hydraulic valve to a vibratory mode which increases in at least one of amplitude and frequency responsive to a period of time that the switch is activated.

8. An apparatus, as set forth in claim 7, wherein the operator controlled switch is a push button switch designed for activation during the period of time the switch is pressed.

9. An apparatus, as set forth in claim 7, wherein the operator controlled switch is a joystick designed for activation during a period of time the joystick is held away from a neutral position, and deactivation when the operator releases the joystick.

10. A computer-based method for operating a work tool on a work machine in a vibratory mode, comprising the steps of:

determining a switch activation indicative of a command to engage the vibratory mode;

actuating the vibratory mode;

increasing at least one of an amplitude and a frequency of vibration responsive to a period of time that the switch is activated;

determining a switch deactivation indicative of a command to disengage the vibratory mode; and responsively disengaging the vibratory mode.

* * * * *